United States Patent [19]

Salice

[11] Patent Number: 4,674,148

[45] **Date of Patent: * Jun. 23, 1987**

[54] HINGE BRACKET AND MOUNTING PLATE ASSEMBLY PROVIDED WITH A SPRING-BIASED PIVOTED DETENT LEVER AND AN ABUTMENT FOR ENGAGING THE SAME

[75] Inventor: Luciano Salice, Carimate, Italy

[73] Assignee: Arturo Salice S.p.A., Como, Italy

[ * ] Notice: The portion of the term of this patent subsequent to Nov. 29, 2000 has been disclaimed.

[21] Appl. No.: 676,421

[22] Filed: Nov. 29, 1984

[30] Foreign Application Priority Data

Dec. 13, 1983 [DE] Fed. Rep. of Germany ..... 3345063
Jul. 26, 1984 [DE] Fed. Rep. of Germany ..... 3427607

[51] Int. Cl.[4] ..... E05D 7/12
[52] U.S. Cl. ..... 16/258; 16/382
[58] Field of Search ..... 16/258, 382, 383, 384, 16/DIG. 40

[56] References Cited

U.S. PATENT DOCUMENTS 4,417,366 11/1983 Salice ..... 16/382
4,423,537 1/1984 Salice ..... 16/382
4,430,771 2/1984 Salice ..... 16/382
4,517,706 5/1985 Lautenschlager et al. ..... 16/383

FOREIGN PATENT DOCUMENTS 2513089 10/1975 Fed. Rep. of Germany .... 16/DIG. 43
352577 9/1979 Fed. Rep. of Germany .... 16/DIG. 43

*Primary Examiner*—Fred Silverberg
*Attorney, Agent, or Firm*—Morgan & Finnegan

[57] ABSTRACT

There is disclosed a hinge bracket and mounting plate assembly wherein one of the parts consisting of the hinge bracket and the mounting plate is provided with a spring-biased pivoted detent lever and the other of the parts is provided with an abutment, which interengages with the detent lever, and wherein the lever and abutment snap into a position in which they are releasably interengaged after the hinge bracket has been inserted into a track of the mounting plate and has been longitudinally displaced therein. A stop is provided, which limits the displacement as the lever and abutment snap into position or after they have snapped into position. One of the members consisting of the lever and the abutment has a beveled or rounded engaging face, the other of the members has a backing edge or backing face, and the engaging face and the backing edge or face bear on each other at an angle of attack which is smaller than the angle of friction.

14 Claims, 11 Drawing Figures

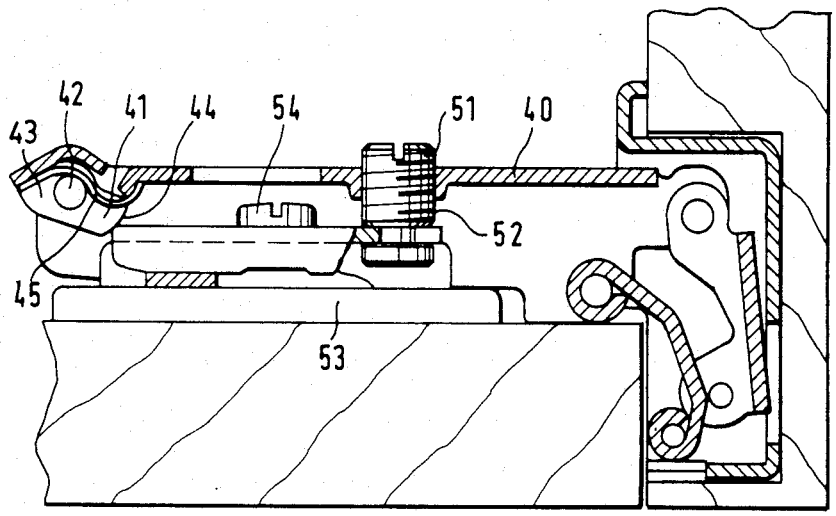
FIG. 7
FIG. 8
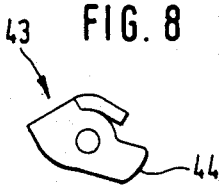
FIG. 10
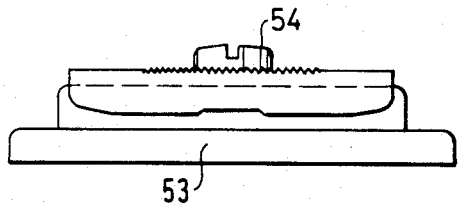
FIG. 9
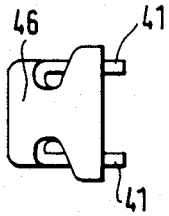
FIG. 11
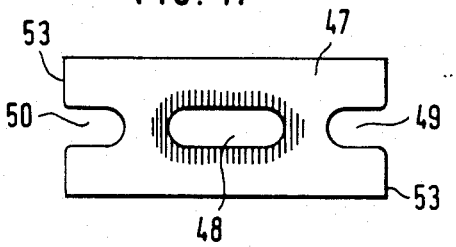

HINGE BRACKET AND MOUNTING PLATE ASSEMBLY PROVIDED WITH A SPRING-BIASED PIVOTED DETENT LEVER AND AN ABUTMENT FOR ENGAGING THE SAME

BACKGROUND OF THE INVENTION

1. Field of the Invention

This invention relates to a hinge bracket and mounting plate assembly, wherein one part is provided with a spring-biased pivoted detent lever and the other part with an abutment, which interengages with the detent lever, and wherein the lever and abutment snap into a position in which they are releasably interengaged after the hinge bracket has been inserted into a track of the mounting plate and has been longitudinally displaced therein, and a stop is provided, which limits the displacement as the lever and abutment snap into position or after they have snapped into position 2. Description of the Prior Art European Patent Publication No. 43,903 and corresponding U.S. Pat. No. 4,430,771 disclose a hinge bracket and mounting plate assembly of that kind. In that known assembly the releasable interengagement is effected by means of a detent lever, which is provided with a detent projection and which enters a detent opening of the cooperating member in such a manner that a wedge-shaped side face of the detent projection engages the edge of said detent opening so that the lever is self-biasing and the hinge bracket is held against the stop of the mounting plate without backlash. The known snap joint permits a quick and simple assembling of hinges because it is sufficient to push the hinge bracket onto the mounting plate, which has previously been fixed in position. Since the side face of the spring-biased detent projection always applies pressure to the edge of the detent opening, the mounting plate and the hinge bracket are forced against each other without backlash. However, that known snap joint for fixing the hinge bracket to the mounting plate is relatively expensive and will not produce an effective self-biasing action unless the detent lever is biased by a relatively strong spring. For this reason, it is an object of the invention to simplify the structure of the known assembly and to improve the self-biasing action thereof.

SUMMARY OF THE INVENTION

This object is accomplished in accordance with the invention by providing a construction in which one of the members consisting of the lever and the abutment has a beveled or rounded engaging face, the other of the members has a backing edge or backing face, and the engaging face and said backing edge or face bear on each other at an angle of attack which is smaller than the angle of friction. In the assembly in accordance with the invention the hinge bracket is locked to the mounting plate in a simple manner in which the detent lever and the abutment bear on each other at an oblique angle or at right angles to the engaging face and pressure is applied to the detent lever in such a manner that a tensile force exerted on the hinge bracket will tend to increase the force by which the detent lever engages the abutment. The locking action is substantially due only to the frictional force which is exerted by the lever or by the abutment on the engaging face. For this reason the spring which biases the detent lever may be rather weak because that spring is only required to turn the detent lever against the abutment if the joint is slack or if there is a backlash in the joint.

In the assembly in accordance with the invention the engaging side face may be formed on the detent lever or on the abutment and the other of the parts will be provided with the backing edge or backing face.

The location where the backing edge or backing face is engaged by the engaging face is suitably disposed between the pivot pin of the detent lever and the forward end of the hinge bracket, i.e., the end provided with the bearing bores.

Due to the angle of attack which has been selected, the frictional force acting on the detent lever owing to its engagement with the abutment tends to turn the detent lever in the locking direction. The engaging force may also be due to the weight of the detent lever and to the assisting force of the spring.

The hinge bracket consists suitably of a channel-shaped sheet metal stamping. The detent lever is pivoted near the end of that stamping on a pivot pin that extends between and is secured to the flanges of the bracket and the end portion of the hinge bracket is locked to the mounting plate so that a stable fixation is ensured by the large effective lever arm of the hinge bracket.

The engaging face may be provided on the hinge bracket or on the mounting plate. A simpler structure will be obtained, however, if the engaging face is provided at the rear end of the mounting plate.

The track for guiding lugs bent from the flanges of the hinge bracket may be defined by a base plate provided with a retaining block mounted on the base plate and by a channel-shaped cover plate, which is screw-connected to the base plate and is formed with flanges having edges which face the base plate and define the track, said base plate and the cover plate constituting the mounting plate.

The engaging faces are suitably provided on the rear end portions of the flanges of the cover plate.

In accordance with a preferred further feature of the invention the detent lever consists of a U-shaped sheet metal stamping having two legs, which constitute detent levers, which cooperate with respective engaging faces. The two-armed detent lever may be mounted on a pivot pin, which extends between and is secured to the flanges of the hinge bracket and extends through bores in the legs of the detent lever, whereas the web of the hinge bracket constitutes an unlocking key, which is disposed in the free space between the longitudinally protruding flanges of the cover plate and is operable to effect a release. The unlocking key can easily be operated by hand because it may be biased by a weak spring force and the actuation of the unlocking key may be utilized also to push the hinge bracket from the mounting plate.

A leaf spring may be provided, which bears on the webs of the hinge bracket and of the detent lever and on the pivot pin disposed between the webs and the spring may be prestressed in such a manner that it tends to raise the arm of the detent lever that is provided with the web so that the detent lever is forced against the engaging face of the abutment.

The detent lever may be provided at its forward end with a tip which is similar to a knife edge and which bears on the engaging face. By that tip, the coefficient of friction will be increased so that the angle of friction will be increased too.

The side face which constitutes the abutment may have a relatively small inclination so that an interlock between the hinge bracket and the mounting plate is ensured over a relatively large distance of travel.

In accordance with a desirable feature, the engaging face is constituted by the end face or end faces of one or both legs of the detent lever. In that case the abutment may be constituted by the rear edge of the cover plate.

The base plate and the cover plate are desirably symmetrical with respect to their longitudinal and transverse center lines so that a left-hand hinge and a right-hand hinge can be installed in a simple manner. The end portions of those side walls which are constituted by the flanges of the cover plate are suitably bevelled so that the tracks have entrance portions which taper in wedge shape.

Additional preferred features of the invention will be apparent from the following description thereof which is to be taken in conjunction with the accompanying Drawings.

BRIEF DESCRIPTION OF THE DRAWINGS

FIG. 7 is a longitudinal sectional view showing a second embodiment of a hinge bracket locked to the mounting plate.

FIG. 8 is a side elevation showing the detent lever of the hinge bracket of FIG. 7.

FIG. 9 is a top plan view showing the detent lever of FIG. 8.

FIG. 10 is a side view in elevation showing the mounting plate illustrated in FIG. 7 and consisting of a base plate and a cover plate.

FIG. 11 is a top plan view showing the cover plate of FIGS. 7 and 10.

DESCRIPTION OF THE PREFERRED EMBODIMENT

Figure 1:
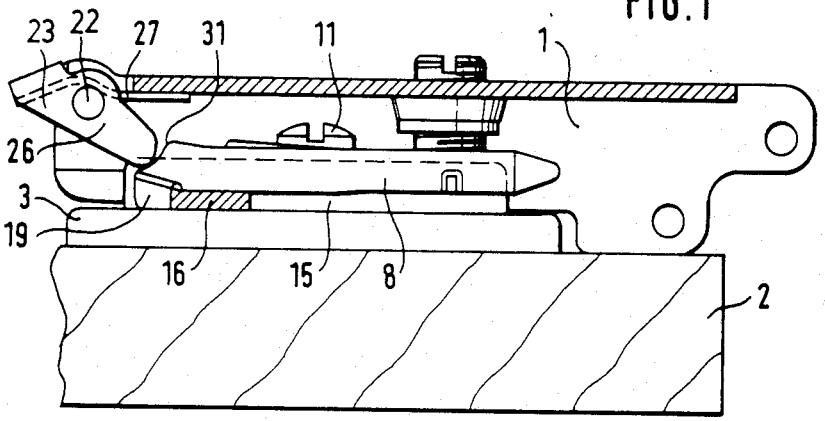
FIG. 1 is a longitudinal sectional view showing a hinge bracket locked to the mounting plate.

Two illustrative embodiments of the invention will now be described more in detail with reference to the drawings.

With reference to FIGS. 1 to 6, the base plate 3, which may be formed with bores 4, 5 for fixing screws, is connected by such screws to a carrying wall 2, to which the hinge bracket 1 is to be secured. Carrying wall 2 may constitute a wall of a cupboard or another corpus part. The base plate 3 is rectangular and in its middle region is provided with a retaining block 6, which is extended in length at both ends in H shape by the provision of arms 7. The retaining block 6 provided with such extension arms 7 is rectangular in cross-section and constitutes a retaining and guiding member for a cover plate 8, which is screw-connected to the retaining block 6. The cover plate 8 consists of a channel-shaped sheet metal member, which is formed in its web with a slot 9 and at its forward end with an open-ended slot 10. By means of a retaining screw 11 screwed into a tapped bore 12 of the retaining block 6 the cover plate 8 is secured to the base plate 3 in such a manner that the flanges 13 and 14 of the cover plate 8 extend on opposite sides of the track that is defined by the retaining block 6 and the arms 7. The screw 11 extends through the slot 9, which permits a longitudinal displacement of the cover plate and of the hinge bracket relative to the base plate 3 when the screw 11 is loosened.

When the cover plate 8 has been screw-connected to the base plate 3, the lower edges of the flanges 13, 14 of the cover plate 8 are sufficiently spaced above the lateral portions of the base plate 3 so that grooves 15 are provided on both sides of the arms 7. The grooves are adapted to receive and guide lugs 16, which are provided on the hinge bracket 1 and are angled inwardly from the flanges 17 of the hinge bracket.

The flanges 13, 14 of the cover plate 8 are provided in their rear end portions with extensions 18, 19, which extend to and engage the cover plate 3 to constitute stops, which in the manner shown in FIG. 1 are engageable by the lugs 16 which have been pushed into the track grooves 15.

Figure 2:
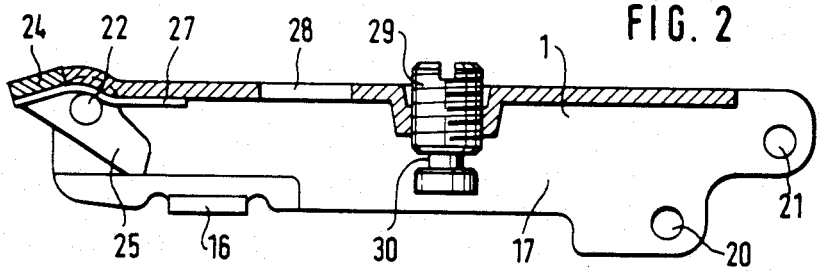
FIG. 2 is a longitudinal sectional view showing the hinge bracket which has been detached from the mounting plate.
Figure 4:
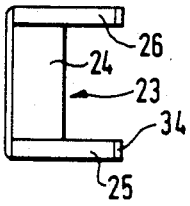
FIG. 4 is a rear view in elevation showing the cover plate of FIG. 3.
Figure 3:
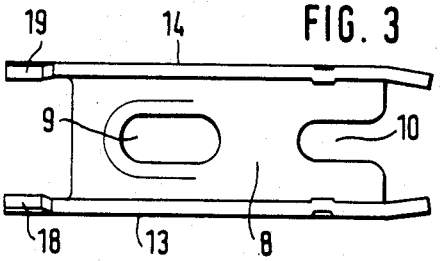
FIG. 3 is a bottom view showing the cover plate connectable by screws to the base plate.
Figure 5:
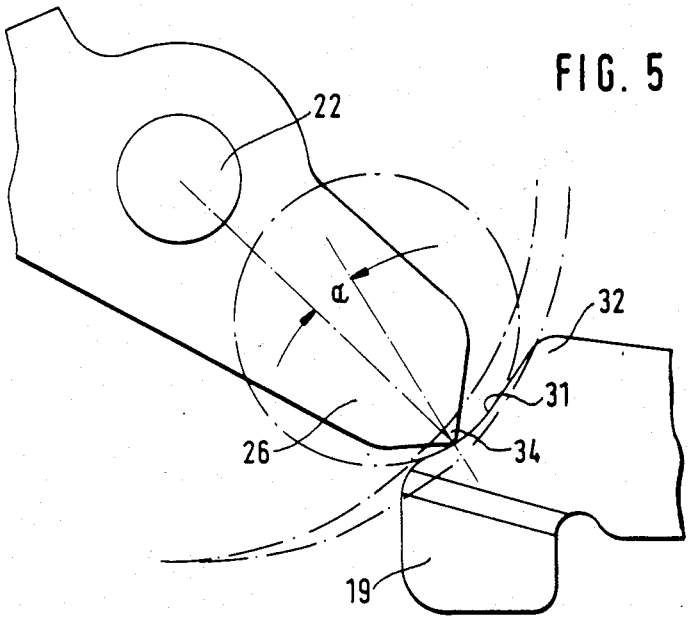
FIG. 5 is a side elevation showing on a larger scale the detent lever bearing on the curved engaging face.
Figure 6:
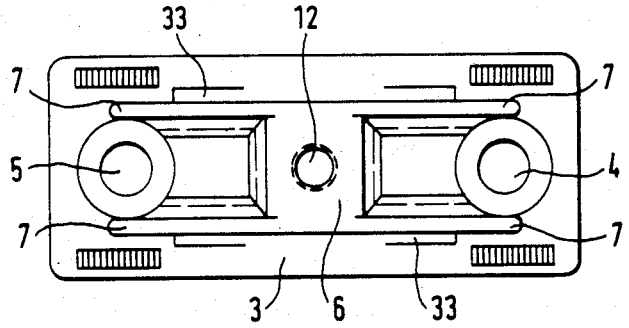
FIG. 6 is a top plan view showing the base plate after the cover plate has been removed.

The flanges 17 of the hinge bracket are formed in their forward portion with bores 20, 21, for receiving the hinge pin. In the rear portion of the hinge bracket 1, a pivot pin 22 is secured to the flanges 17. The detent lever 23 is mounted on said pivot pin 22 and is U-shaped, as is shown in FIGS. 1, 2 and 4. The web 24 of the detent lever 23 constitutes an unlocking key. The legs 25, 26 of the detent lever are angled from said web and are formed with knife edges 34 at their free lower ends. The pivot pin 22 extends through bores in the legs of the detent lever 23 so that the latter is double-armed. A leaf spring 27 bears on the pivot pin 22 and at both ends engages the webs of the detent lever 23 and of the hinge bracket 1 under initial stress.

The web of the hinge bracket 1 is also formed with a window 28, through which the fixing screw 11 is accessible, and with a flanged tapped bore for receiving an adjusting screw 29. The adjusting screw 29 is formed in its lower portion with an annular groove 30, which receives the edges of the slot 10.

The flanges 13, 14 of the cover plate 8 are provided in their rear portions with engaging faces 31 on the side which is opposite to the extensions 18, 19. The engaging faces are shown on a larger scale in FIG. 5. As long as the angle $\alpha$ between the line connecting the knife edge 34 to the center line of the pivot pin 22, on the one hand, and the normal on the engaging face 31, on the other hand, is smaller than the angle of friction, the detent lever will reliably engage the engaging face so that the hinge bracket will be safely locked to the mounting plate.

The cover plate 8 has been blanked so that its flanges 13, 14 extend longitudinally beyond the web. The rear portions of the flanges are slightly increased in height to form a hump 32 so that when the hinge bracket 1 is pushed onto the mounting plate the legs 25, 26 of the detent lever 23 will move over the hump 32 and will move to their locking position with an improved snap action.

That portion of the base plate 3 which laterally protrudes on the outside of the arms 7 is provided with wedge-shaped ramps 33, which rise toward the ends of the base plate. As the hinge bracket 1 is pushed onto the mounting plate, the lugs 16 which are angled inwardly from the flanges 17 of said bracket will be forced by said ramps 33 against the lower edges of the flanges 13, 14 of the cover plate 8. The wedge-shaped ramps 33 are arranged in mirror symmetry with respect to the transverse axis of the base plate 3 so that the hinge bracket can be mounted on the base plate in positions facing left and right. To ensure that the pushing of the hinge bracket onto the mounting plate will not be obstructed by the ramps 33 which are first engaged by the hinge bracket, the flanges 13, 14 of the cover plate have lower forward portions, as is apparent from FIG. 1.

The flanges 13, 14 of the cover plate 8 are extended forwardly and are rounded and angled inwardly.

In the embodiment shown in FIGS. 7 to 11, the detent lever 43 is pivoted on the pivot pin 42 at the rear end of the hinge bracket 40 and has legs 41, which are provided at their outer end faces with arcuately curved engaging faces 44, which are eccentric to the pivot pin 42 in such a manner that in a side view they progressively depart from the center line of the pivot pin approximately in spiral shape.

The detent lever 43 is acted upon by the leaf spring 45, which is curved in S shape and tends to move the detent lever 43 in a clockwise sense in FIG. 7. The leaf spring 44 bears with its middle portion on the pivot pin 42 and with its end portions on the flanges of the hinge bracket 40 and on the legs of the detent lever 43. The web 46 of the detent lever 43 constitutes an unlocking key.

The intermediate or cover plate 47 is channel-shaped and has a centrally disposed slot 48 for receiving the fixing screw 54 and at its end has outwardly open slots 49, 50, the edges of which are adapted to extend into an annular groove 52 of an adjusting screw 51, as is shown in FIG. 7.

The rear upper end edges 53 of the web of the cover plate 47 constitute the abutments which are engageable by the engaging faces 44 of the detent lever 43. When the hinge bracket has been mounted, the shank of the adjusting screw 51 bears at the bottom of its annular groove 52 on the edge at the end of the slot 49 or 50 and is forced against that edge by the pressure applied by the engaging face 44 to the backing edges 53.

I claim:

1. A hinge bracket and mounting plate assembly comprising a hinge bracket having lugs thereon and a mounting plate having an elongated track and wherein one of the parts consisting of said hinge bracket and said mounting plate is provided with a spring-biased pivoted detent lever mounted on a pivot pin therefor and the other of said parts is provided with an abutment which interengages with said detent lever and wherein said detent lever and said abutment snap into a position in which they are releasably interengaged when the hinge bracket is inserted into and longitudinally displaced in said track located on said mounting plate and the lugs on said hinge bracket limit the displacement of said hinge bracket when the lever and abutment snap into said position, one of the members consisting of the part provided with said detent lever and the part provided with said abutment having a beveled engaging face and the other of said members having a backing face, said engaging face and said backing face bearing on each other at an angle of attack which is smaller than the angle of friction and the frictional force acting on said detent lever owing to its engagement with said abutment tending to turn the detent lever in a locking direction.

2. A hinge bracket and mounting plate assembly according to claim 1, wherein the backing face is engaged by the engaging face at a point located between the pivot pin for the detent lever and the forward end of the hinge bracket and said detent lever is stressed by compression.

3. A hinge bracket and mounting plate assembly according to claim 1, wherein the free end of the detent lever is forced by a spring against the abutment which is constituted by the beveled engaging face and which adjoins a sliding surface which is approximately parallel to the track.

4. A hinge bracket and mounting plate assembly according to claim 3 wherein the hinge bracket includes a web comprising a tongue which protrudes over the pivot pin of said detent lever.

5. A hinge bracket and mounting plate assembly according to claim 1 wherein the mounting plate comprises a base plate provided with a retaining block mounted thereon and by a channel-shaped cover plate, which is screw-connected to said base plate and is formed with flanges having edges which face said base plate and define the track on said mounting plate and base base plate being provided near the end portions of the track with wedge-shaped ramps, arranged in mirror symmetry, and which rise toward the ends of said base plate.

6. A hinge bracket and mounting plate assembly according to claim 5 wherein the engaging faces are formed on the rear end portions of the flanges of the cover plate.

7. A hinge bracket and mounting plate assembly according to claim 5 wherein the detent lever consists of a U-shaped sheet metal stamping having two legs and a connecting web, and is two-armed, and the pivot pin therefor extends between and is secured to the flanges of the hinge bracket, extending through bores in the legs of said detent lever, and the hinge bracket includes a web forming an unlocking key, disposed in the free space between longitudinally protruding flanges of the cover plate and operable to effect a release of said hinge bracket.

8. A hinge bracket and mounting plate assembly according to claim 7 wherein the detent lever also includes a prestressed leaf spring which bears on the web of the hinge bracket and of said detent lever and on the pivot pin disposed between said webs.

9. A hinge bracket and mounting plate assembly according to claim 7 wherein the engaging face is constituted by the end face of at least one of the legs of the detent lever.

10. A hinge bracket and mounting plate assembly according to claim 9 wherein the abutment is constituted by the rear end of the web of the cover plate.

11. A hinge bracket and mounting plate assembly according to claim 5 including a stop engageable by the hinge bracked, said stop being constituted by a centrally disposed slot, which is formed in the forward end of the cover plate and is forwardly open, and the edges of said slot extend into an annular groove formed in a screw, which has been screwed into the web portion of the hinge bracket.

12. A hinge bracket and mounting plate assembly according to claim 5 wherein the base plate and the cover plate are symmetrical with respect to their longitudinal and transverse center lines.

13. A hinge bracket and mounting plate assembly according to claim 1 wherein the detent lever is provided at its forward end with a tip similar to a knife edge.

14. A hinge bracket and mounting plate assembly according to claim 1 wherein the detent lever is inclined with respect to the mounting plate and is at an acute angle with respect to the hinge bracket.

* * * * *